US009820908B2

(12) United States Patent
Elia

(10) Patent No.: US 9,820,908 B2
(45) Date of Patent: Nov. 21, 2017

(54) APPARATUS AND METHOD FOR REHABILITATING AN INJURED LIMB

(75) Inventor: Shlomo Elia, Ramat Gan (IL)

(73) Assignee: Rehabit-Tec Ltd., Ramat Gan (IL)

( * ) Notice: Subject to any disclaimer, the term of this patent is extended or adjusted under 35 U.S.C. 154(b) by 535 days.

(21) Appl. No.: 14/127,183

(22) PCT Filed: Jun. 21, 2012

(86) PCT No.: PCT/IL2012/000256

§ 371 (c)(1),
(2), (4) Date: Dec. 18, 2013

(87) PCT Pub. No.: WO2012/176200

PCT Pub. Date: Dec. 27, 2012

(65) Prior Publication Data

US 2014/0142470 A1 May 22, 2014

(30) Foreign Application Priority Data

Jun. 23, 2011 (IL) ..... 213756

(51) Int. Cl.
*A61H 1/02* (2006.01)
*A61H 1/00* (2006.01)
(Continued)

(52) U.S. Cl.
CPC ..... *A61H 1/00* (2013.01); *A61H 1/0288* (2013.01); *A63B 21/008* (2013.01); *A63B 21/0058* (2013.01); *A63B 21/00069* (2013.01); *A63B 21/4019* (2015.10); *A63B 21/4021* (2015.10); *A63B 23/16* (2013.01); *A61H 1/0237* (2013.01); *A61H 1/0266* (2013.01);
(Continued)

(58) Field of Classification Search
CPC .... A61H 2201/1269; A61H 2201/1276; A61H 1/00; A61H 1/02; A61H 1/0237; A61H 1/0262; A61H 1/0274; A61H 1/0277; A61H 1/0281; A61H 1/0285; A61H 1/0288
See application file for complete search history.

(56) References Cited

U.S. PATENT DOCUMENTS 5,865,770 A * 2/1999 Schectman ..... A61H 1/02 601/23
2003/0120183 A1 6/2003 Simmons
(Continued)

FOREIGN PATENT DOCUMENTS

WO 2009/070042 A2 6/2009
WO 2010/059066 A1 5/2010

OTHER PUBLICATIONS

International Search Report/Written Opinion, dated Sep. 24, 2012, issued in corresponding PCT/IL2012/000256, filed Jun. 21, 2012.

*Primary Examiner* — Michael Tsai
(74) *Attorney, Agent, or Firm* — Francis J. Coffey; Dann, Dorfman, Herrell and Skillman

(57) ABSTRACT

A method and apparatus for rehabilitation and training of an injured limb by using the corresponding functional healthy limb to control the motion of the injured limb are presented. A sensor system on the healthy and active limb, a processing unit, and a power supply are provided in the apparatus to provide signals that activate a powered mechanism configured for moving individual bones on the injured passive limb.

16 Claims, 3 Drawing Sheets

(51) Int. Cl.

| | |
|---|---|
| ***A63B 23/16*** | (2006.01) |
| ***A63B 21/008*** | (2006.01) |
| ***A63B 21/00*** | (2006.01) |
| ***A63B 21/005*** | (2006.01) |
| *A63B 24/00* | (2006.01) |
| *A63B 22/00* | (2006.01) |

(52) U.S. Cl.

CPC .... *A61H 1/0274* (2013.01); *A61H 2201/1215* (2013.01); *A61H 2201/1238* (2013.01); *A61H 2201/1276* (2013.01); *A61H 2201/149* (2013.01); *A61H 2201/165* (2013.01); *A61H 2201/1635* (2013.01); *A61H 2201/501* (2013.01); *A61H 2201/5064* (2013.01); *A61H 2201/5084* (2013.01); *A61H 2201/5092* (2013.01); *A61H 2201/5097* (2013.01); *A63B 2022/0094* (2013.01); *A63B 2024/0065* (2013.01); *A63B 2024/0068* (2013.01); *A63B 2024/0093* (2013.01); *A63B 2220/40* (2013.01); *A63B 2220/803* (2013.01); *A63B 2220/805* (2013.01); *A63B 2220/833* (2013.01); *A63B 2220/836* (2013.01); *A63B 2225/20* (2013.01); *A63B 2225/50* (2013.01)

(56) References Cited

U.S. PATENT DOCUMENTS

| | | | | |
|---|---|---|---|---|
| 2004/0267331 | A1 | 12/2004 | Koeneman et al. | |
| 2006/0206167 | A1* | 9/2006 | Flaherty | A61H 1/0255 607/48 |
| 2008/0108883 | A1 | 5/2008 | Scott et al. | |
| 2008/0234113 | A1* | 9/2008 | Einav | A61B 5/1116 482/66 |
| 2010/0152629 | A1 | 6/2010 | Haas, Jr. et al. | |
| 2010/0249675 | A1* | 9/2010 | Fujimoto | A61H 1/0285 601/40 |
| 2010/0305717 | A1* | 12/2010 | Tong | A61H 1/0285 623/64 |
| 2011/0071443 | A1 | 3/2011 | Weisz et al. | |
| 2011/0136626 | A1 | 6/2011 | Wei et al. | |

* cited by examiner

APPARATUS AND METHOD FOR REHABILITATING AN INJURED LIMB

CROSS-REFERENCE TO RELATED APPLICATIONS

This application is the U.S. National Stage of International Application No. PCT/IL2012/000256, filed Jun. 21, 2012, which claims priority from Israeli Patent Application No. 213756, filed Jun. 23, 2011. The entire disclosure of each of the aforesaid applications is incorporated by reference in the present application.

FIELD OF THE INVENTION

The present invention relates to rehabilitation apparatus. More specifically the present invention relates to an apparatus for rehabilitation of a person who has suffered traumatic injury more specifically a stroke.

BACKGROUND OF THE INVENTION

A stroke, previously known medically as a Cerebro vascular accident (CVA), is the rapidly developing loss of brain function(s) due to disturbance in the blood supply to the brain. This can be due to ischemia (lack of blood flow) caused by blockage (arterial embolism) or a hemorrhage (leakage of blood). As a result, the affected area of the brain is unable to function, leading to inability to move one or more limbs on one side of the body.

In the United States more than 700,000 people suffer a stroke each year, and approximately two-thirds of these individuals survive and require rehabilitation. The goals of rehabilitation are to help survivors become as independent as possible and to attain the best possible quality of life. Even though rehabilitation does not "cure" stroke in that it does not reverse brain damage, rehabilitation can substantially help people achieve the best possible long-term outcome.

Paralysis is one of the most common disabilities resulting from stroke. The paralysis is usually on the side of the body opposite the side of the brain damaged by the stroke, and may affect the face, arm, leg, or the entire side of the body. This one-sided paralysis is called hemiplegia (one-sided weakness is called hemiparesis). Stroke patients with hemiparesis or hemiplegia may have difficulty with everyday activities such as walking or grasping objects.

After a stroke, the damaged lobe loses the ability to control its limbs (the crossover limbs) while the neighboring lobe may remain unharmed and fully in control of its limbs. It has been clinically proven that one lobe can be trained to control not only the crossover limbs but the limbs on the same side as well. This fact is the driving force behind physical therapy treatments for stroke victims.

Dysfunction of a limb and inability to move and perform functional activities of every day live, which calls for physical therapy, can be caused by at least two types of injuries; neurological injuries and physical injuries. Neurological injuries can include trauma brain injuries (TBI) due to external mechanical force on the brain and non-traumatic brain injuries due to internal deficiencies which damage the brain, e.g. stroke. Physical injuries are injuries caused by external force directly on one of the limbs.

To enable a person who suffered from a stroke or any other injury that causes dysfunction of a limb, to restore, as much as possible, normal functioning of the disabled limb, many hours of physical therapy are necessary. For best results physical therapy should start as soon as possible after injury; in the case of stroke, preferably within 24 to 48 hours. However, because of lack of rehabilitation centers, shortage of physical therapists and experts the average patient begins therapy after the critical period and, after starting physical therapy, the patient receives only infrequent sessions.

It is a purpose of the present invention to provide an apparatus and method for treating neurological injured victims that will improve physical therapy results and educating crossover healthy parts of the brain to control the limb instead of the injured part.

It is a purpose of the present invention to provide an apparatus and method for treating individuals, who have medical problems or other health-related conditions, illnesses, or injuries that limit their abilities to move and perform functional activities as well as they would like in their daily lives.

It is yet another purpose of the present invention to reduce the cost of rehabilitation by enabling a patient to train himself and reduce the hours of work with a physical therapist.

It is another purpose of the present invention to provide a method and apparatus for a physical and neurological therapy training program which will restore normal functioning of a disabled limb and enable an individual stroke victim to function in a nearly normal fashion in real life situations.

Further purposes and advantages of this invention will appear as the description proceeds.

SUMMARY OF THE INVENTION

In a first aspect the invention is an apparatus for rehabilitation and training of an injured limb by using the corresponding functional healthy limb to control the motion of the injured limb. The apparatus comprises:

a) a sensor system comprising sensors for measuring the relative motion of a bone on one side of a joint and the bone on the other side of the joint on the functional healthy limb;

b) a powered mechanism comprising actuators adapted to cause relative motion of a bone on one side of a joint and the bone on the other side of the joint on the injured limb;

c) a processing and communication module adapted to receive output signals from each of the sensors in the sensor system, to analyze the signals, and to produce and transmit to the powered mechanism signals comprising instructions related to the duration and magnitude of the force that should be applied by the components of the powered mechanism in order to force a bone on the injured limb to move in exactly the same way that the corresponding bone on the healthy limb moved; and d) a power supply adapted to supply power to the components of the sensor system, the powered mechanism, and the processing and communication module.

In embodiments of the apparatus the components of the sensor system are be mounted directly on the functional healthy limb and the components of the powered mechanism are mounted directly on the injured limb.

In embodiments of the apparatus the components of the sensor system are mounted on an exoskeleton into which the functional healthy limb can be slipped and the components of the powered mechanism are mounted on an exoskeleton into which the injured limb can be slipped. The exoskeleton can be made of a flexible, rigid, or semi-rigid material.

The sensor system can comprise analog sensors, digital sensors, or both analog and digital sensors. In embodiments of the apparatus the sensors are selected from at least one of the following types of sensor: accelerometer sensors, strain gauges, bend sensors, fiber optic sensors, and Hall Effect sensors.

In embodiments of the apparatus analog sensors are connected to the bones of the functionally healthy hand by means of cables or rods connected to anchor points located between the joints of the functionally healthy hand.

In embodiments of the apparatus digital sensors that are located directly over the joints of the functionally healthy hand.

In embodiments of the apparatus the actuators of the powered mechanism are connected to the bones of the injured hand by means of cables or rods connected to anchor points located between the joints of the injured hand.

The signals sent to and from the processing and communication module can be sent over a wired or a wireless communication link. In embodiments of the apparatus the sensors of the sensor system and actuators of the powered mechanism can have a unique IP address.

In embodiments of the apparatus the powered mechanism comprises a feedback sensor system which is adapted to provide real time information to the processing and communication module, which uses the information to adjust the magnitude of the force of the actuators on the injured limb.

In a second aspect the invention is method of using the apparatus of the first aspect for rehabilitation and training of an injured limb by using the corresponding functional healthy limb to control the motion of the injured limb. The method comprises:

a) mounting a sensor system comprising sensors for measuring the relative motion of a bone on one side of a joint and the bone on the other side of the joint on the functional healthy limb;
b) mounting a powered mechanism comprising actuators adapted to cause relative motion of a bone on one side of a joint and the bone on the other side of the joint on the injured limb; and
c) carrying out a series of movements of the bones of the functional healthy limb.

All the above and other characteristics and advantages of the invention will be further understood through the following illustrative and non-limitative description of embodiments thereof, with reference to the appended drawings. In the drawings the same numerals are sometimes used to indicate the same elements in different drawings.

DETAILED DESCRIPTION OF EMBODIMENTS OF THE INVENTION

The present invention is a method and apparatus used for rehabilitation and training of an injured limb by using the corresponding functional healthy limb to control the motion of the injured limb. The apparatus comprises a sensor system for the healthy and active limb, a powered mechanism for moving individual bones on the injured passive limb, a processing unit, and a power supply.

As the user moves the healthy limb, the movement of each of the bones is measured by the sensors, transmitted to and processed by the processor, which then transmits a signal to the powered mechanism that activates the corresponding actuators on the injured limb forcing the specific bone to move in exactly the same way that the bone on the healthy limb moved.

The fact that the user sees the repeated motion of his healthy and injured limb, i.e. by allowing the user to create repeatedly movements with his healthy limb and to observe the (mechanically made) movements projected onto his injured limb, creates a bio-feedback cycle which, in the case of neurological injury, can retrain the brain and the neurological system to allow them eventually to regain control of the injured limb.

The term limb used in the present invention refers to any one of the jointed appendages of a human or animal, such as an arm, foot, hand and leg, used for locomotion or grasping. The invention can be applied to any of the jointed appendages mentioned above. In order to illustrate the invention the specific case of retraining a human hand that has been paralyzed as a result of a stroke or any other kind of injury will be described herein. On the base of the following description the skilled man of the art will know how to adapt the invention mutatis mutandis for use with a different type of limb.

Figure 1:
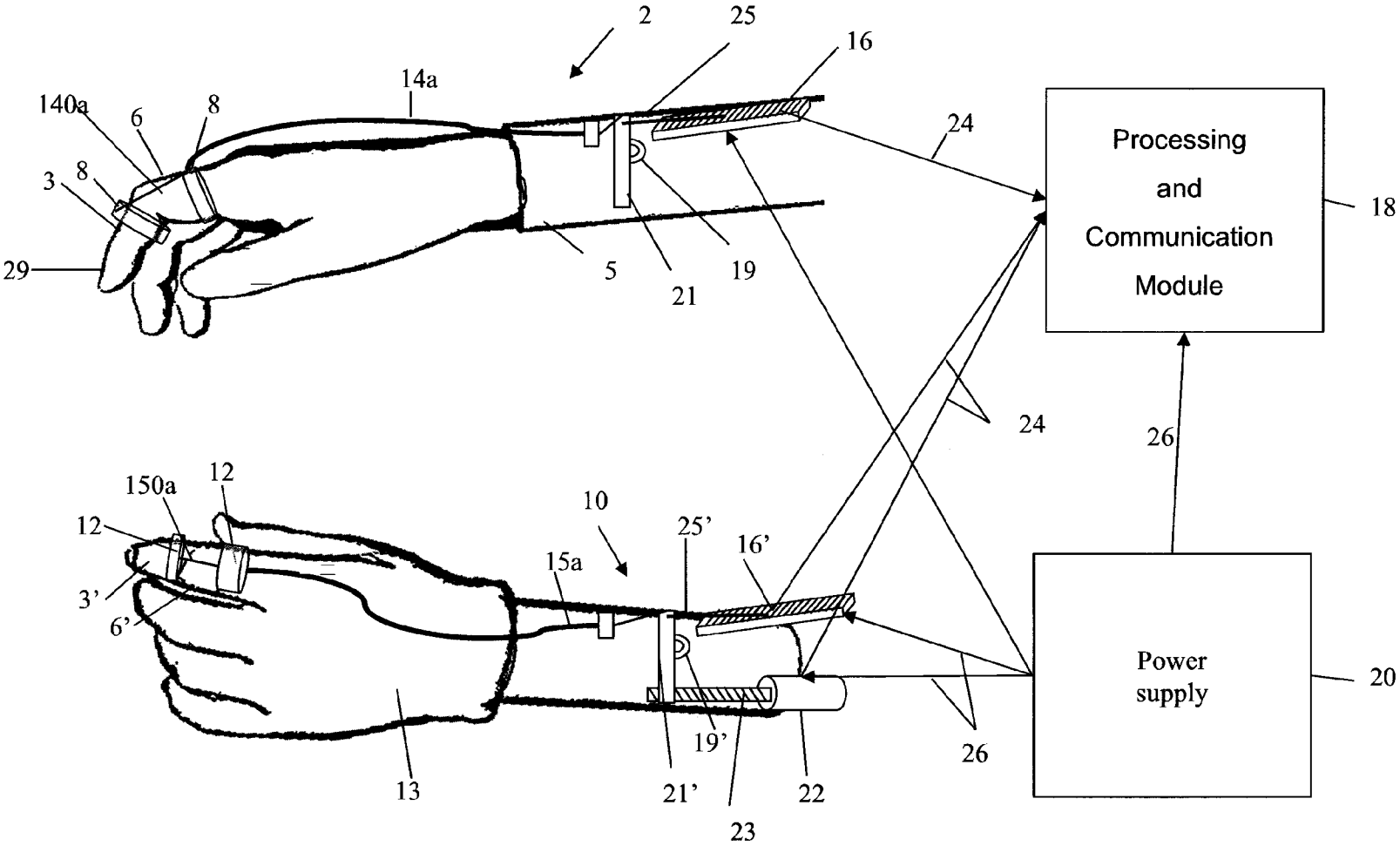
FIG. 1 illustrates schematically an embodiment of the system of the invention.

FIG. 1 schematically shows the principal components of one embodiment of the invention. These components are: A sensor system (2), which comprises a plurality of digital or analogical sensors to track the movement of individual digital bones of the fingers of the hand, is mounted on a healthy functional limb (5). A powered mechanism (10) includes actuators for moving the different bones of the injured limb in response to the measurements made by the sensor system (2) on the healthy limb (5). A processing and communication module (18) and a power supply (20).

The figure shows an analog system. In this embodiment the sensors of sensor system (2) are potentiometers (16), which are connected by cables (14*a*) and (140*a*) to remote sensors anchor points (8) that are secured on each digital bone (3) on healthy hand (5). Anchor points (8) can be attached directly to the finger, e.g. in the form of rings as shown in FIG. 1 or can be attached to an exoskeleton that can be fitted over the entire hand as will be described herein below. (Note that for clarity only the minimum number of sensors, cables, etc. required to describe the apparatus and explain the method are shown in the figures.)

When the hand is used, for example to grasp or release an object, adjacent bones in each finger move with respect to one another. The movement of one digital bone, herein designated the object bone (3), in relation to another bone, herein designated the reference bone (6), is detected by the sensors. The object bone (3) and the reference bone (6) are connected by a joint that permits relative movement of one with respect to the other. In the example illustrated the object bone (3) is the intermediate phalange and the reference bone (6) is the proximal phalange.

In the embodiment shown in FIG. 1, the sensor system comprises for each joint on the fingers of the hand, a set of flexible cables (140*a*, 14*a*) to measure the relative movement of the object bone relative to the reference bone when the joint is bent. The set of cables comprises an internal cable (140*a*) that passes through the hollow center of an external cable (14*a*). The external cable, which is essentially a flexible tube is attached at one of its ends to an anchor point (8) on reference bone (6) and at its other end to a fixed location on the arm of the patient. The internal cable (140*a*) is attached at one of its ends to anchor point (8) on the object bone (3), passes through the hollow center of external cable (14*a*) and is connected at its other end to lever (21). Bending of the joint between object bone (3) and reference bone (6) causes the inner cable (140*a*) to pull on lever (21), which rotates about pivot (19), pulling on linkage (25) and changing the output of potentiometer (16). Not seen in the figure is a spring located on pivot (19). The spring pulls back on the end of the lever to which the inner cable is attached so that, when the joint on the finger is straightened, the tension in the inner cable is maintained and linkage (25) is pushed in the opposite direction changing the output of potentiometer (16). The output of potentiometer (16) is transmitted to the processing and communication module (18).

In this way the movements of the object bone (3) in relation to the reference bone (6) are transferred to the related sensor by pull of the cable. As long as the bones move together, the distance between the anchor points (8) on the object bone (3) and reference bone (6) stays constant, the potentiometer isn't moved and the system doesn't react. That is the wrist is free to move as long as the external and internal cables move together.

The sensors can be either digital or analog, e.g. accelerometer sensors, strain gauges, bend sensors, fiber optic sensors, or Hall Effect sensors. In the case in which digital sensors are used the sensors are located on the bones at the locations of anchor points (8). The output signals from each sensor or potentiometer can be transmitted by either a wired communication link (24) to processor module (18). In embodiments of the invention wireless transmitters having a unique IP address are associated with some or all of the sensors and communication link (24) is a wireless network that uses, for example, wi-fi or bluetooth technology.

In the processing and communication module (18) the output of each of the sensors (16) is analyzed and then signals are transmitted to a powered mechanism (10) on the injured limb (13). The transmitted signals are instructions related to the duration and magnitude of the force that should be applied by the components of the powered mechanism (10) to each specific bone on the injured limb (13) in order to cause that bone to move in exactly the same way that the corresponding bone on the functional limb (5) moved.

One example of an actuator that can be used in the powered mechanism (10) is a miniature electric motor that is fixedly attached to the arm of the patient and mechanically linked to cables or rods that are connected to anchor points (12) on the digital bones. Another example is a pneumatic or hydraulic pump and a driving jig connected to the bones in a similar manner. The actuators receive the electric power to activate them from power supply (20) by means of a network of wires 26.

In the embodiment shown in FIG. 1, the actuator for moving the object digital bone relative to the reference bone is a small electric motor (22) that is activated by instructions received from the processor unit (18). On the injured hand, as opposed to the healthy hand, for each joint the powered mechanism (10) comprises two sets of flexible cables (150*a*, 15*a*) one on the top of the joint to cause the straightening of the joint and another similar set (not shown in the Fig. for clarity) on the bottom to cause bending of the joint. Each set of cables comprises an internal cable (150*a*) that passes through the hollow center of an external cable (15*a*). The external cable, which is essentially a flexible tube is attached at one end to an anchor point (12) on the reference bone and at the other end to a location on the arm above the wrist. The internal cable (150*a*) is attached at one end to an anchor point (12) on the reference bone, passes through the hollow center of external cable (15*a*) and is connected to one end of lever (21). Anchor points (12) can be attached directly to the finger, e.g. in the form of rings as shown in FIG. 1 or can be attached to an exoskeleton that can be fitted over the entire hand as will be described herein below.

The motor (22) is coupled to a screw (23) which, depending on the direction the screw it is rotated by the motor, causes the end of lever 21' it is attached to be pushed forward or pulled backwards. As the end of lever (21') connected to the screw (23) moves, the lever (21') rotates around pivot (19') pulling on the ends of cables (150*a*) causing the object bone to move relative to the reference bone causing the joint between them to bend or be straightened depending on if the top or bottom internal cable is pulled.

According to one embodiment of the invention a feedback sensor system is provided on the injured hand. The feedback sensor system is identical to the sensor assembly (2) on the healthy hand (5). In the embodiment shown in FIG. 1, the cables and anchor points of the powered mechanism (10) that are used to move the injured fingers are also utilized for the feedback sensor system. The end of lever (21') of the powered mechanism to which the cables (150*a*) on the top and bottom of the finger are connected is also connected by linkage (25') to potentiometer (16'). As lever (21) moves, linkage (25') is pushed or pulled changing the output signal of potentiometer (16'). The output of potentiometer (16') is transmitted to the processor and communication module (18).

The feedback sensor system on the injured limb provides real time information to module (18), which uses this information to adjust the magnitude of the force of the actuators on the injured limb (13). This feedback is important in order to match the motion of the digital bones on the injured limb (13) exactly with that of the corresponding digital bone on the healthy limb (5) and prevent the application of excessive force to the bone which could further injure the hand.

Herein above the invention has been illustrated with an amendment in which the anchor points (8) and (12) are rings placed on the bones of the fingers and the sensors, actuators and other components are attached directly to the arm of the patient above the wrist. At the beginning of each therapy session all of these components have to be attached to the fingers and arm of the patient, the length of the cables might have to be adjusted and all of the electrical connections made or at least checked. At the end of each session the system has to disassembled and removed from the patient's hands and arms. These are complex procedures that require time and coordination and are not something that the patient is able to do by himself. A much more practical way of implementing the invention is to attach the component of the system to exoskeletons which fit over the limbs.

The exoskeleton can be fabricated from a flexible material e.g. elasticized cloth or an elastomer and supplied in a range of sizes to fit limbs of different sizes. The anchor points (8, 12) can be attached to the exoskeleton by any means known in the art, e.g. welding, sewing, gluing, or riveting.

Embodiments of the exoskeleton can be manufactured from a rigid or semi-rigid material such as aluminum, heavy gauge sheet metal, plastic and hard rubber. For comfort the exoskeleton can be padded on the inside and supplied in a range of sizes with some embodiments adapted to be adjustable to fit limbs of different sizes. In these embodiments anchor points (8, 12) can be attached to the exoskeleton by any means known in the art, e.g. welding, gluing, or riveting, or can be created directly on the surface during the manufacturing process.

An exoskeleton made of a rigid material is preferred in the case of a neurologically injured limb since and it is much easier to slide the injured hand into a rigid exoskeleton, which also will give better support to the flaccid limb than a flexible exoskeleton can provide.

Figure 2:
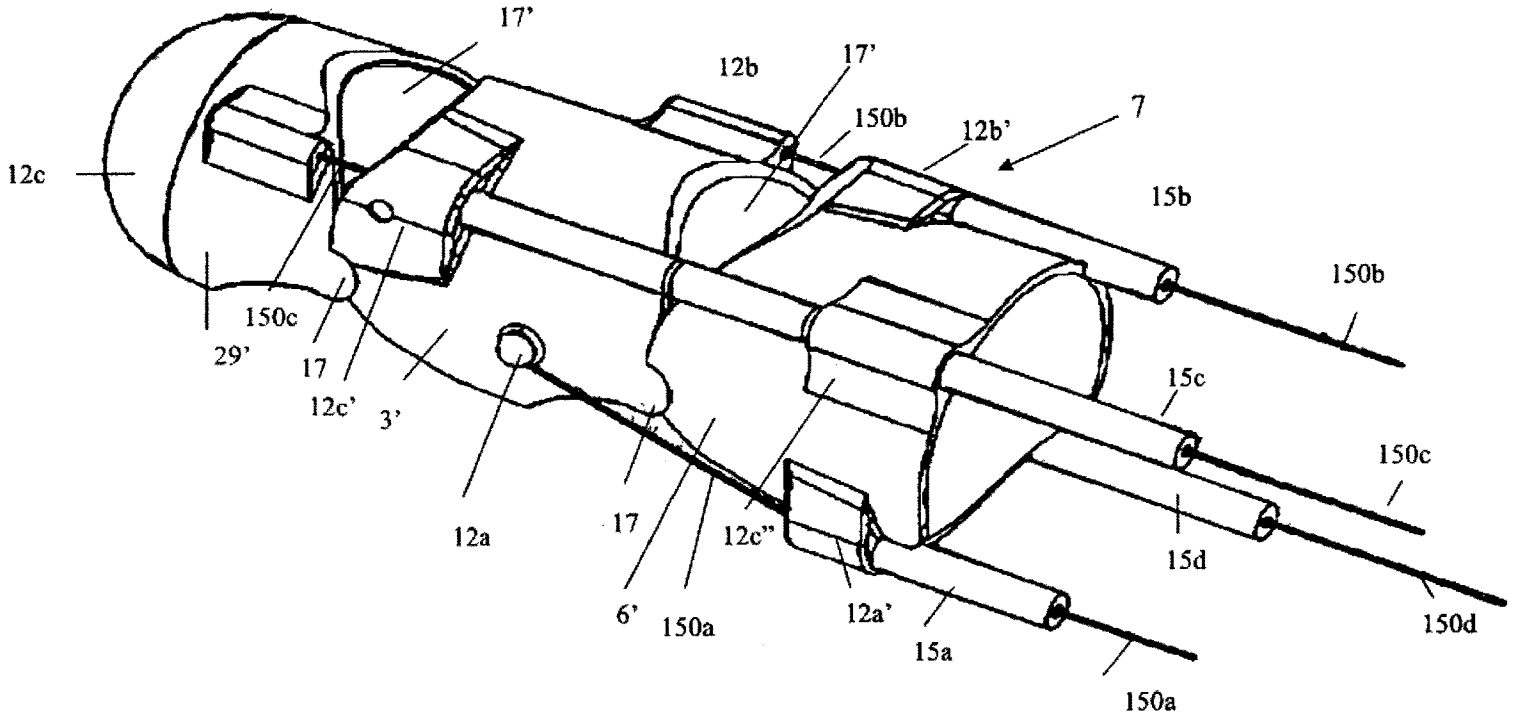
FIG. 2 is an example of an exoskeleton for one finger used to ensure the placement of the means that measure or create movements of the digital bones.

FIG. 2 illustrates a section (one finger) of an embodiment of an exoskeleton (7) for use on an injured human hand. In this embodiment of the invention, the part of the exoskeleton is constructed from hard plastic material. It is comprised of a base shell and three cylindrical shells for each of the four fingers and two cylindrical shells for the thumb. As shown in FIG. 2, the three shells (29'), (3'), and (6') that make up each finger are connected at pivots points (17), allowing the joints of the fingers to be freely bent or straightened. The length of each shell is a little shorter than the bone that will fit inside of it and, when the hand is inside the exoskeleton (7), the pivot points (17) are on the sides of each joint, with the knuckles of the fingers centered in the open area (17') between shells. The proximal shell of each finger (6') is pivotably connected to a base shell (not shown) that is a cuff that covers the wrist or to a longer sleeve that extends part way up the arm to provide a surface for attachment of motors, etc. In the later case provision is made for allowing bending of the wrist and elbow (if the sleeve extends beyond the elbow). The embodiment that comprises a sleeve allows training of an entire injured limb and not only the fingers.

In FIG. 2 external cables (15*a*) and (15*b*) and corresponding internal cables (150*a*) and (150*b*) are used to respectively bend and straighten shell (3') with shell (6') as reference and external cables (15*d*) and (15*c*) and corresponding internal cables (150*d*) and (150*c*) are used to respectively bend and straighten shall (29') with shell (3') as reference. The ends of internal cables (150*a*) and (150*b*) that are not connected to anchor points (12*a*) and (12*b*) are connected to the end of a lever (21') that can be moved by a motor as shown in FIG. 1. A separate but similar arrangement of lever and motor exists for the pair of internal cables (150*c*) and (150*d*). Thus, when the motors are activated by the processing and communication module pulling on the internal cables, the shells and the bones of the finger inside of each shell will be forced to move mirroring the motion of the corresponding bones in the healthy hand.

Figure 3:
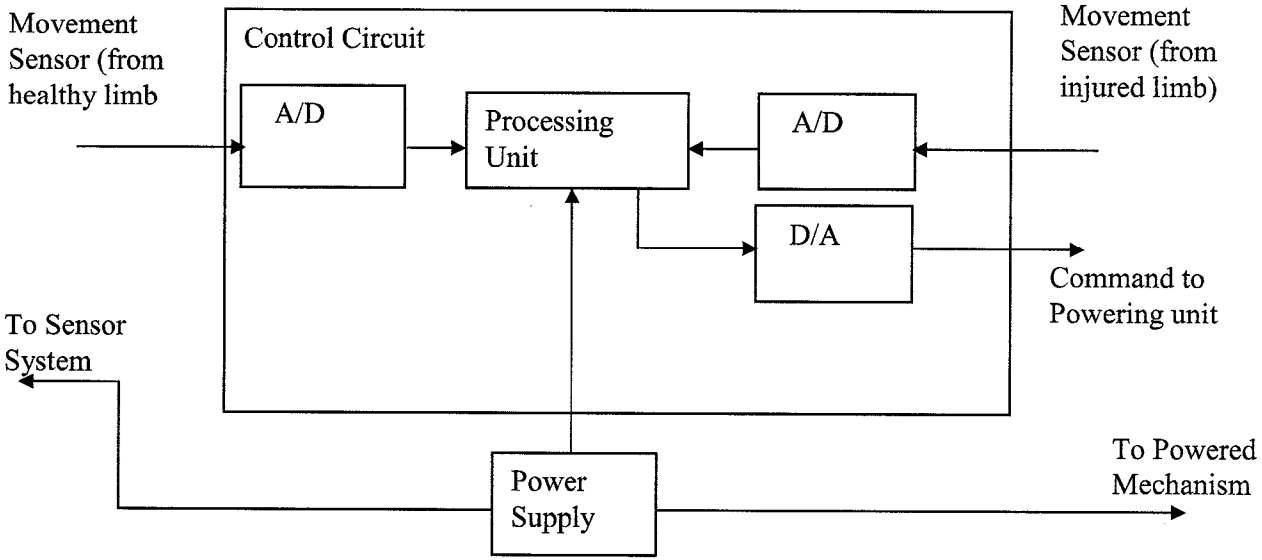
FIG. 3 is a block diagram which shows the main features of the control circuit.

FIG. 3 is a general block diagram presenting an embodiment of a control circuit of the invention. The analog/digital conversion elements connected to the sensor arrays are not necessary when digital sensors are used. The processing and communication module (18) may be a dedicated unit attached to or separated from the rest of the apparatus or it can be a general purpose computer, PC, or hand held device. In addition to the processor itself, this module comprises other components including: one or more input/output bus bars to facilitate electrical connection with the components of the apparatus; transmitting and receiving means for wireless and/or wired communication with the sensors; one or more memory units to record the activities and results of the sessions and historical data that show the progress of the patient; input devices, e.g. keyboard, touch pad, or touch screen, to input information about the patient or details of the session and instructions to the apparatus, for example limiting the maximum amount of force that can be applied by the actuators on the injured limb; and output devices, e.g. a display screen or audible signals to allow the progress and results of the session to be monitored. In addition, regardless of the type of processing unit employed, the processor is loaded with dedicated software adapted to receive the signals from the sensors and convert them into instructions to the actuators and also to control the overall operation of the apparatus.

The power supply (20) can supply either direct current, e.g. from rechargeable batteries, or low voltage alternating current to the sensor system (2) on the healthy limb, the powered mechanism (10) on the injured limb, and processor and communication module (18) by means of electric wires (26) as required.

The apparatus of the invention enables a patient to train himself and to reduce the hours of work with a physical therapist. For self-training sessions without the presence of a physical therapist, a patient receives, together with the apparatus of the invention, a training program with specific instructions of the kind and number of movements to be done with the healthy hand. Movements of the healthy hand will cause, according to the invention, movements in the injured limb, which will help regain use of the injured limb. Basically the healthy limb is used to replace the physical therapist in the training of the injured limb. According to an embodiment of the invention the apparatus comprises, as mention above, means to allow the progress and results of the session to be monitored, further enabling the absence of a therapist.

The invention described is an apparatus and a method for performing self physiotherapy and providing biofeedback for training a neurologically damaged joint using its healthy mirror counterpart in the body. The invention enables better rehabilitation and promotes new neurological paths by providing biofeedback of the injured joint movements according to the brains commands. As well, the invention allows lower cost of physiotherapy by enabling the patient to train himself.

Although embodiments of the invention have been described by way of illustration, it will be understood that the invention may be carried out with many variations, modifications, and adaptations, without exceeding the scope of the claims.

The invention claimed is:

1. An apparatus for rehabilitation and training of an injured hand by using the corresponding functional healthy hand to control the motion of said injured hand, said apparatus comprising:

a) a sensor system comprising sensors for measuring the relative motion of a bone on one side of a joint and the bone on the other side of said joint for each joint on the fingers of said functional healthy hand;

b) a powered mechanism comprising actuators adapted to cause relative motion of a bone on one side of a joint and the bone on the other side of said joint for each joint on the fingers of said injured hand;

c) a processing and communication module adapted to receive output signals from each of the sensors in said sensor system, to analyze said signals, and to produce and transmit to said powered mechanism signals comprising instructions related to the duration and magnitude of the force that should be applied by the components of the powered mechanism in order to force each bone on said injured hand to move in exactly the same way that the corresponding bone on the healthy hand moved; and d) a power supply adapted to supply power to the components of said sensor system, said powered mechanism, and said processing and communication module.

2. The apparatus of claim 1, wherein the components of the sensor system are mounted on an exoskeleton which is adapted to be slipped over the functional healthy hand and the components of the powered mechanism are mounted on an exoskeleton which is adapted to be slipped over the injured hand.

3. The apparatus of claim 2, wherein each of the exoskeletons are made of a flexible material.

4. The apparatus of claim 2, wherein each of the exoskeletons are made of a rigid or semi-rigid material.

5. The apparatus of claim 1, wherein the sensor system comprises sensors from at least one of the following groups: analog sensors, digital sensors, and both analog and digital sensors.

6. The apparatus of claim 5, wherein the sensor system comprises sensors selected from at least one of the following types of sensor: accelerometer sensors, strain gauges, bend sensors, fiber optic sensors, and Hall Effect sensors.

7. The apparatus of claim 5, wherein the sensors of the sensor system are analog sensors that are adapted to be connected to the bones of the functionally healthy hand by means of cables or rods connected to anchor points adapted to be located between the joints of said functionally healthy hand.

8. The apparatus of claim 5, wherein the sensors of the sensor system are digital sensors that are adapted to be located directly over the joints of the functionally healthy hand.

9. The apparatus of claim 1, wherein the actuators of the powered mechanism are adapted to be connected to the bones of the injured hand by means of cables or rods connected to anchor points that are adapted to be located between the joints of said injured hand.

10. The apparatus of claim 1, wherein at least one of the signals sent to and from the processing and communication module are sent over a wired communication link.

11. The apparatus of claim 1, wherein at least one of the signals sent to and from the processing and communication module are sent over a wireless communication link.

12. The apparatus of claim 11, wherein at least one of the sensors of the sensor system or actuators of the powered mechanism has a unique IP address.

13. The apparatus of claim 1, wherein the powered mechanism comprises a feedback sensor system which is adapted to provide real time information to the processing and communication module, which uses said information to adjust the magnitude of the force of the actuators on the injured hand.

14. The apparatus of claim 1, wherein all of the components of the sensor system are adapted to be mounted directly on the arm connected to the functional healthy hand or on the functional healthy hand.

15. The apparatus of claim 1, wherein, the actuators of the powered mechanism comprise one of:

(a) a miniature electric motor that is located on and configured to be fixedly attached to the arm connected to the injured hand of the patient and mechanically linked to cables or rods that are connected to anchor points on the digital bones; and (b) a pneumatic or hydraulic pump and a driving jig that is located on and configured to be fixedly attached to the arm connected to the injured hand of the patient and mechanically linked to cables or rods that are connected to anchor points on the digital bones.

16. A method of using the apparatus of claim 1 for rehabilitation and training of an injured hand by using the corresponding functional healthy limb to control the motion of said injured hand, said method comprising:

a) mounting a sensor system comprising sensors for measuring the relative motion of a bone on one side of a joint and the bone on the other side of said joint for each joint on the fingers of said functional healthy hand;

b) mounting a powered mechanism comprising actuators adapted to cause relative motion of a bone on one side of a joint and the bone on the other side of said joint for each joint on the fingers of said injured hand; and c) carrying out a series of movements of the bones of said functional healthy hand.

* * * * *